US009522561B2

(12) United States Patent
To

(10) Patent No.: US 9,522,561 B2
(45) Date of Patent: Dec. 20, 2016

(54) RING BINDER MECHANISM

(71) Applicant: World Wide Stationery Mfg. Co., Ltd., Hong Kong (CN)

(72) Inventor: Chen Yuen To, Hong Kong (CN)

(73) Assignee: World Wide Stationery Mfg. Co., Ltd., Kwai Chung, New Territories (HK)

( * ) Notice: Subject to any disclaimer, the term of this patent is extended or adjusted under 35 U.S.C. 154(b) by 240 days.

(21) Appl. No.: 14/470,538

(22) Filed: Aug. 27, 2014

(65) Prior Publication Data

US 2015/0063896 A1 Mar. 5, 2015

(30) Foreign Application Priority Data

Aug. 27, 2013 (CN) ..... 2013 1 0380263
Aug. 27, 2013 (CN) ..... 2013 2 0525782

(51) Int. Cl.

| | |
|---|---|
| ***B42F 13/20*** | (2006.01) |
| ***B42F 13/22*** | (2006.01) |
| ***B42F 13/24*** | (2006.01) |
| ***B42F 13/16*** | (2006.01) |
| ***B42F 13/26*** | (2006.01) |

(52) U.S. Cl.

CPC ..... *B42F 13/26* (2013.01); *B42F 13/16* (2013.01); *B42F 13/20* (2013.01); *B42F 13/22* (2013.01); *B42F 13/24* (2013.01)

(58) Field of Classification Search

CPC ..... B42F 13/16; B42F 13/20; B42F 13/22; B42F 13/24
USPC ..... 402/29–31, 36–38, 41
See application file for complete search history.

(56) References Cited

U.S. PATENT DOCUMENTS

| | | | |
|---|---|---|---|
| 419,160 | A | 1/1890 | Smith |
| 566,717 | A | 8/1896 | Krah |
| 621,256 | A | 3/1899 | Krah |

(Continued)

FOREIGN PATENT DOCUMENTS

| | | | |
|---|---|---|---|
| CA | 2500817 | A1 | 9/2005 |
| CN | 102126374 | A | 7/2011 |

(Continued)

OTHER PUBLICATIONS

Kokuyo Lock Ring Mechanism with description, two instruction sheets, and nine photographs, date unknown but admitted as prior art, 12 pgs.

*Primary Examiner* — Kyle Grabowski
(74) *Attorney, Agent, or Firm* — Senniger Powers LLP

(57) ABSTRACT

A ring binder mechanism for holding loose-leaf pages has a housing and rings movable between closed and open positions. The rings are mounted on hinge plates supported by the housing for pivoting movement relative to the housing. An actuator is moveable relative to the housing to pivot the hinge plates to move the rings between the closed and open positions. A travel bar operatively connected to the actuator includes a locking element. The travel bar is moveable between a locked position in which the locking element blocks pivoting of the hinge plates and an unlocked position in which the locking element permits pivoting of the hinge plates. The travel bar and housing each include a retaining formation. The retaining formation on the housing is adapted to contact the retaining formation on the travel bar to releasably hold the travel bar in the locked position when the rings are closed.

23 Claims, 12 Drawing Sheets

(56) References Cited

U.S. PATENT DOCUMENTS

| | | | |
|---|---|---|---|
| 651,254 | A | 6/1900 | Krah |
| 683,019 | A | 9/1901 | Buchanan |
| 779,879 | A | 1/1905 | Sheridan et al. |
| 790,382 | A | 5/1905 | McBride |
| 854,074 | A | 5/1907 | Bryant |
| 857,377 | A | 6/1907 | Baker |
| 974,831 | A | 11/1910 | Scherzinger |
| 1,011,391 | A | 12/1911 | Sturgis |
| 1,163,179 | A | 12/1915 | Schade, Jr. |
| 1,168,260 | A | 1/1916 | Albrecht |
| 1,398,034 | A | 11/1921 | Mero |
| 1,398,388 | A | 11/1921 | Murphy |
| 1,598,206 | A | 8/1926 | Lindstedt et al. |
| 1,733,548 | A | 10/1929 | Martin |
| 1,733,894 | A | 10/1929 | Martin |
| 1,787,957 | A | 1/1931 | Schade |
| 1,822,669 | A | 9/1931 | Schade |
| 1,824,791 | A | 9/1931 | Rengmann |
| 1,857,291 | A | 5/1932 | Trussell |
| 1,896,839 | A | 2/1933 | Dawson |
| 1,953,981 | A | 4/1934 | Trussell |
| 1,991,362 | A | 2/1935 | Krag |
| 1,996,463 | A | 4/1935 | Dawson et al. |
| 2,004,570 | A | 6/1935 | Dawson |
| 2,013,416 | A | 9/1935 | McClure |
| 2,024,461 | A | 12/1935 | Lotter |
| 2,067,846 | A | 1/1937 | Cooper |
| 2,075,766 | A | 3/1937 | Rand |
| 2,075,767 | A | 3/1937 | Rand |
| 2,081,372 | A | 5/1937 | Thomas |
| 2,089,211 | A | 8/1937 | Krag |
| 2,096,944 | A | 10/1937 | Unger et al. |
| 2,103,307 | A | 12/1937 | Unger |
| 2,105,235 | A | 1/1938 | Schade |
| 2,158,056 | A | 5/1939 | Cruzan |
| 2,179,627 | A | 11/1939 | Handler |
| 2,204,918 | A | 6/1940 | Trussell |
| 2,218,105 | A | 10/1940 | Griffin |
| 2,236,321 | A | 3/1941 | Ostrander |
| 2,239,062 | A | 4/1941 | Tallmadge |
| 2,239,121 | A | 4/1941 | St. Louis et al. |
| 2,251,878 | A | 8/1941 | Hanna et al. |
| 2,252,422 | A | 8/1941 | Unger |
| 2,260,929 | A | 10/1941 | Bloore |
| 2,288,189 | A | 6/1942 | Guinane |
| 2,304,716 | A | 12/1942 | Supin |
| 2,311,492 | A | 2/1943 | Unger |
| 2,322,595 | A | 6/1943 | Schade |
| 2,338,011 | A | 12/1943 | Schade |
| 2,421,799 | A | 6/1947 | Martin |
| 2,528,866 | A | 11/1950 | Dawson, Jr. |
| 2,543,866 | A | 3/1951 | Panfil, Sr. |
| 2,552,076 | A | 5/1951 | Wedge |
| 2,570,323 | A | 10/1951 | Condon et al. |
| 2,612,169 | A | 9/1952 | Segal |
| 2,789,561 | A | 4/1957 | Bonn et al. |
| 2,865,377 | A | 12/1958 | Schroer et al. |
| 2,871,711 | A | 2/1959 | Stark |
| 2,891,553 | A | 6/1959 | Acton |
| 2,894,513 | A | 7/1959 | Gempe et al. |
| 2,950,719 | A | 8/1960 | Lyon |
| 3,077,888 | A | 2/1963 | Thieme |
| 3,098,489 | A | 7/1963 | Vernon |
| 3,098,490 | A | 7/1963 | Wance |
| 3,101,719 | A | 8/1963 | Vernon |
| 3,104,667 | A | 9/1963 | Mintz |
| 3,149,636 | A | 9/1964 | Rankin |
| 3,190,293 | A | 6/1965 | Schneider et al. |
| 3,205,894 | A | 9/1965 | Rankin |
| 3,205,895 | A | 9/1965 | Johnson |
| 3,255,759 | A | 6/1966 | Dennis |
| 3,348,550 | A | 10/1967 | Wolf et al. |
| 3,718,402 | A | 2/1973 | Schade |
| 3,748,051 | A | 7/1973 | Frank |
| 3,884,586 | A | 5/1975 | Michaelis et al. |
| 3,954,343 | A | 5/1976 | Thomsen |
| 3,993,374 | A | 11/1976 | Schudy et al. |
| 4,127,340 | A | 11/1978 | Almgren |
| 4,130,368 | A | 12/1978 | Jacoby et al. |
| 4,222,679 | A | 9/1980 | Luogameno |
| 4,352,582 | A | 10/1982 | Eliasson |
| 4,486,112 | A | 12/1984 | Cummins |
| 4,522,526 | A | 6/1985 | Lozfau et al. |
| 4,566,817 | A | 1/1986 | Barrett, Jr. |
| 4,571,108 | A | 2/1986 | Vogl |
| 4,690,580 | A | 9/1987 | Kissel |
| 4,696,595 | A | 9/1987 | Pinkney |
| 4,798,491 | A | 1/1989 | Lassle |
| 4,813,803 | A | 3/1989 | Gross |
| 4,815,882 | A | 3/1989 | Ohminato |
| 4,886,390 | A | 12/1989 | Silence et al. |
| 4,919,557 | A | 4/1990 | Podosek |
| 5,067,840 | A | 11/1991 | Cooper et al. |
| 5,116,157 | A | 5/1992 | Gillum et al. |
| 5,135,323 | A | 8/1992 | Pinheiro |
| 5,180,247 | A | 1/1993 | Yu |
| 5,255,991 | A | 10/1993 | Sparkes |
| 5,286,128 | A | 2/1994 | Gillum |
| 5,332,327 | A | 7/1994 | Gillum |
| 5,346,325 | A | 9/1994 | Yamanoi |
| 5,354,142 | A | 10/1994 | Yu |
| 5,368,407 | A | 11/1994 | Law |
| 5,378,073 | A | 1/1995 | Law |
| 5,393,155 | A | 2/1995 | Ng |
| 5,393,156 | A | 2/1995 | Mullin et al. |
| 5,476,335 | A | 12/1995 | Whaley |
| 5,524,997 | A | 6/1996 | von Rohrscheidt |
| 5,577,852 | A | 11/1996 | To |
| 5,634,666 | A | 6/1997 | Lee |
| 5,651,628 | A | 7/1997 | Bankes et al. |
| 5,660,490 | A | 8/1997 | Warrington |
| 5,692,847 | A | 12/1997 | Zane et al. |
| 5,692,848 | A | 12/1997 | Wada |
| 5,718,529 | A | 2/1998 | Chan |
| 5,782,569 | A | 7/1998 | Mullin et al. |
| 5,788,392 | A | 8/1998 | Cheung |
| 5,807,006 | A | 9/1998 | Cheung |
| 5,810,499 | A | 9/1998 | Law |
| 5,810,500 | A | 9/1998 | Whaley |
| 5,816,729 | A | 10/1998 | Whaley |
| 5,836,709 | A | 11/1998 | Cheung |
| 5,868,513 | A | 2/1999 | Law |
| 5,879,097 | A | 3/1999 | Cheng |
| 5,882,135 | A | 3/1999 | Ko |
| 5,895,164 | A | 4/1999 | Wu |
| 5,904,435 | A | 5/1999 | Tung |
| 5,924,811 | A | 7/1999 | To et al. |
| 5,957,611 | A | 9/1999 | Whaley |
| 5,975,784 | A | 11/1999 | Whaley |
| 5,975,785 | A | 11/1999 | Chan |
| 6,036,394 | A | 3/2000 | Cheng |
| 6,142,697 | A | 11/2000 | Williams |
| 6,146,042 | A | 11/2000 | To et al. |
| 6,155,737 | A | 12/2000 | Whaley |
| 6,203,229 | B1 | 3/2001 | Coerver |
| 6,206,601 | B1 | 3/2001 | Ko |
| 6,217,247 | B1 | 4/2001 | Ng |
| 6,270,279 | B1 | 8/2001 | Whaley |
| 6,276,862 | B1 | 8/2001 | Snyder et al. |
| 6,293,722 | B1 | 9/2001 | Holbrook et al. |
| 6,364,558 | B1 | 4/2002 | To |
| 6,371,678 | B1 | 4/2002 | Chizmar |
| 6,467,984 | B1 | 10/2002 | To |
| 6,474,897 | B1 | 11/2002 | To |
| 6,533,486 | B1 | 3/2003 | To |
| 6,749,357 | B2 | 6/2004 | Cheng |
| 6,758,621 | B2 | 7/2004 | To |
| 6,821,045 | B2 | 11/2004 | Whaley |
| 6,840,695 | B2 | 1/2005 | Horn |
| 6,916,134 | B2 | 7/2005 | Wong |
| 7,223,040 | B2 | 5/2007 | Koike et al. |
| 7,270,496 | B2 | 9/2007 | Morgan et al. |
| 7,275,886 | B2 * | 10/2007 | Cheng ..... B42F 13/26 402/26 |

(56) References Cited

U.S. PATENT DOCUMENTS

| | | | | |
|---|---|---|---|---|
| 7,296,946 | B2 | 11/2007 | Cheng et al. | |
| 7,404,685 | B2 | 7/2008 | Cheng | |
| 7,478,963 | B2 | 1/2009 | Tanaka et al. | |
| 7,491,006 | B2 | 2/2009 | Whaley | |
| 7,524,127 | B2 | 4/2009 | Petrie et al. | |
| 7,524,128 | B2 | 4/2009 | Cheng | |
| 7,530,755 | B2 | 5/2009 | Whaley | |
| 7,534,064 | B2 | 5/2009 | Cheng | |
| 7,549,817 | B2 | 6/2009 | Cheng et al. | |
| 7,648,302 | B2 | 1/2010 | Zhang et al. | |
| 7,661,898 | B2 | 2/2010 | Ng et al. | |
| 7,661,899 | B2 | 2/2010 | Lin | |
| 7,665,926 | B2 | 2/2010 | Cheng | |
| 7,674,062 | B2 | 3/2010 | Horn | |
| 7,726,897 | B2 | 6/2010 | To et al. | |
| 7,731,441 | B2 | 6/2010 | Ng et al. | |
| 7,748,922 | B2 | 7/2010 | Cheng | |
| 7,819,602 | B2 | 10/2010 | To et al. | |
| 7,828,491 | B2 | 11/2010 | Cheng | |
| 8,052,343 | B2 | 11/2011 | Zhang et al. | |
| 8,186,899 | B2 | 5/2012 | Ng et al. | |
| 2003/0044221 | A1 | 3/2003 | To et al. | |
| 2005/0201818 | A1 | 9/2005 | Cheng | |
| 2005/0207826 | A1 | 9/2005 | Cheng et al. | |
| 2006/0008318 | A1 | 1/2006 | Ng | |
| 2006/0056906 | A1 | 3/2006 | Horn | |
| 2006/0088364 | A1* | 4/2006 | Whaley | B42F 13/26 402/38 |
| 2006/0147254 | A1 | 7/2006 | Cheng | |
| 2006/0251467 | A1 | 11/2006 | Cheng | |
| 2007/0086836 | A1 | 4/2007 | Cheng | |
| 2007/0140780 | A1 | 6/2007 | Petrie et al. | |
| 2008/0008519 | A1 | 1/2008 | To | |
| 2008/0075527 | A1 | 3/2008 | Pi et al. | |
| 2009/0035053 | A1 | 2/2009 | Pi et al. | |
| 2009/0060631 | A1 | 3/2009 | To et al. | |
| 2009/0110469 | A1 | 4/2009 | To et al. | |
| 2009/0110470 | A1 | 4/2009 | To et al. | |
| 2010/0166490 | A1 | 7/2010 | Cheng et al. | |
| 2011/0170942 | A1 | 7/2011 | Huang et al. | |
| 2013/0287476 | A1 | 10/2013 | Huang | |
| 2014/0140754 | A1* | 5/2014 | Whaley | B42F 13/26 402/41 |
| 2014/0186094 | A1 | 7/2014 | Lin | |
| 2014/0348570 | A1* | 11/2014 | Whaley | B42F 13/26 402/41 |

FOREIGN PATENT DOCUMENTS

| | | | |
|---|---|---|---|
| CN | 102529498 | A | 7/2012 |
| EP | 1431065 | | 6/2004 |
| FR | 1336765 | A | 9/1963 |
| FR | 1346864 | A | 12/1963 |
| FR | 2221924 | | 10/1974 |
| FR | 2238332 | A5 | 2/1975 |
| GB | 837875 | A | 6/1960 |
| GB | 868724 | | 5/1961 |
| GB | 906279 | | 9/1962 |
| GB | 952536 | | 3/1964 |
| GB | 2275023 | A | 8/1994 |
| GB | 2292343 | A | 2/1996 |
| GB | 2387815 | A | 10/2003 |
| JP | 5979379 | U | 5/1984 |
| JP | 6118880 | U | 2/1986 |
| JP | 62-189178 | U | 12/1987 |
| JP | 1299095 | A | 12/1989 |
| JP | 2034289 | U | 3/1990 |
| JP | 4120085 | U | 10/1992 |
| JP | 06-171287 | | 6/1994 |
| JP | 10-217662 | A | 8/1998 |
| JP | 10-329470 | | 12/1998 |
| JP | 2004098417 | A | 4/2004 |
| WO | 2013026351 | A1 | 2/2013 |

* cited by examiner

RING BINDER MECHANISM

FIELD OF INVENTION

This invention relates generally to a ring binder mechanism for retaining loose-leaf pages, and in particular to a ring binder mechanism having a locking system that automatically locks the rings in the closed position.

BACKGROUND OF THE INVENTION

Ring binder mechanisms retain loose-leaf pages on rings. Ring binder mechanisms can be used in notebooks, files, briefcases, clipboards and other similar objects to give the object a loose-leaf page retaining function. A conventional ring binder mechanism has rings formed by ring members that are selectively moveable to open the rings to add and/or remove loose leaf pages and close the rings to retain loose-leaf pages on the rings. The ring members are commonly mounted on adjoining hinge plates supported by a housing for pivoting movement between open and closed positions. The undeformed housing is slightly narrower than the combined width of the hinge plates such that the housing applies a spring force that biases the ring members against movement toward the open position when they are in the closed position. If this spring force is strong, there is a risk that a user could be injured by getting a finger pinched between the ring members as the housing causes them to snap shut during closing. Thus, it is desirable to design the housing so it exerts a relatively light spring force on the ring members to reduce the risk of injury to users.

However, the absence of a strong biasing force holding the ring members in the closed position increases the risk that the rings will inadvertently open (e.g., if the ring mechanism is accidentally dropped) and fail to retain loose-leaf pages. One way to reduce the risk the rings will inadvertently open is to provide a locking system that blocks pivoting movement of the ring members from the closed position to the open position. It is desirable for the locking system to automatically lock the rings closed when the rings are moved to the closed position. It is also desirable to be able to unlock and open the rings in a single step to make the ring mechanism convenient to use.

SUMMARY OF THE INVENTION

One aspect of the invention is a ring binder mechanism for holding loose-leaf pages. The mechanism has an elongate housing. The mechanism has rings for holding the loose-leaf pages. Each ring including a first ring member and a second ring member. The first ring members are moveable relative to the housing and the second ring members between a closed position and an open position. In the closed position the first and second ring members form a substantially continuous, closed loop for allowing loose-leaf pages retained by the rings to be moved along the rings from one ring member to the other. In the open position the first and second ring members forming a discontinuous, open loop for adding or removing loose-leaf pages from the rings. First and second hinge plates are supported by the housing for pivoting motion relative to the housing. The first ring members are mounted on the first hinge plate and moveable with the pivoting motion of the first hinge plate between the closed and open positions. The mechanism has an actuator moveable relative to the housing to cause the pivoting motion of the hinge plates. The actuator is moveable between a first position in which the ring members are in the closed position and a second position in which the ring members are in the open position. A travel bar is operatively connected to the actuator. The travel bar includes a locking element. The travel bar is moveable between a locked position in which the locking element blocks pivoting movement of the hinge plates to move the rings from the closed position to the open position and an unlocked position in which the locking element permits pivoting movement of the hinge plates to open the rings. The travel bar and housing each include a retaining formation. The retaining formation on the housing is adapted to contact the retaining formation on the travel bar to releasably hold the travel bar in the locked position when the rings are closed.

Other objects and features of the invention will be in part apparent and in part pointed out hereinafter.

BRIEF DESCRIPTION OF THE DRAWINGS

Corresponding reference numbers indicate corresponding parts throughout the views of the drawings.

DETAILED DESCRIPTION

Figure 1:
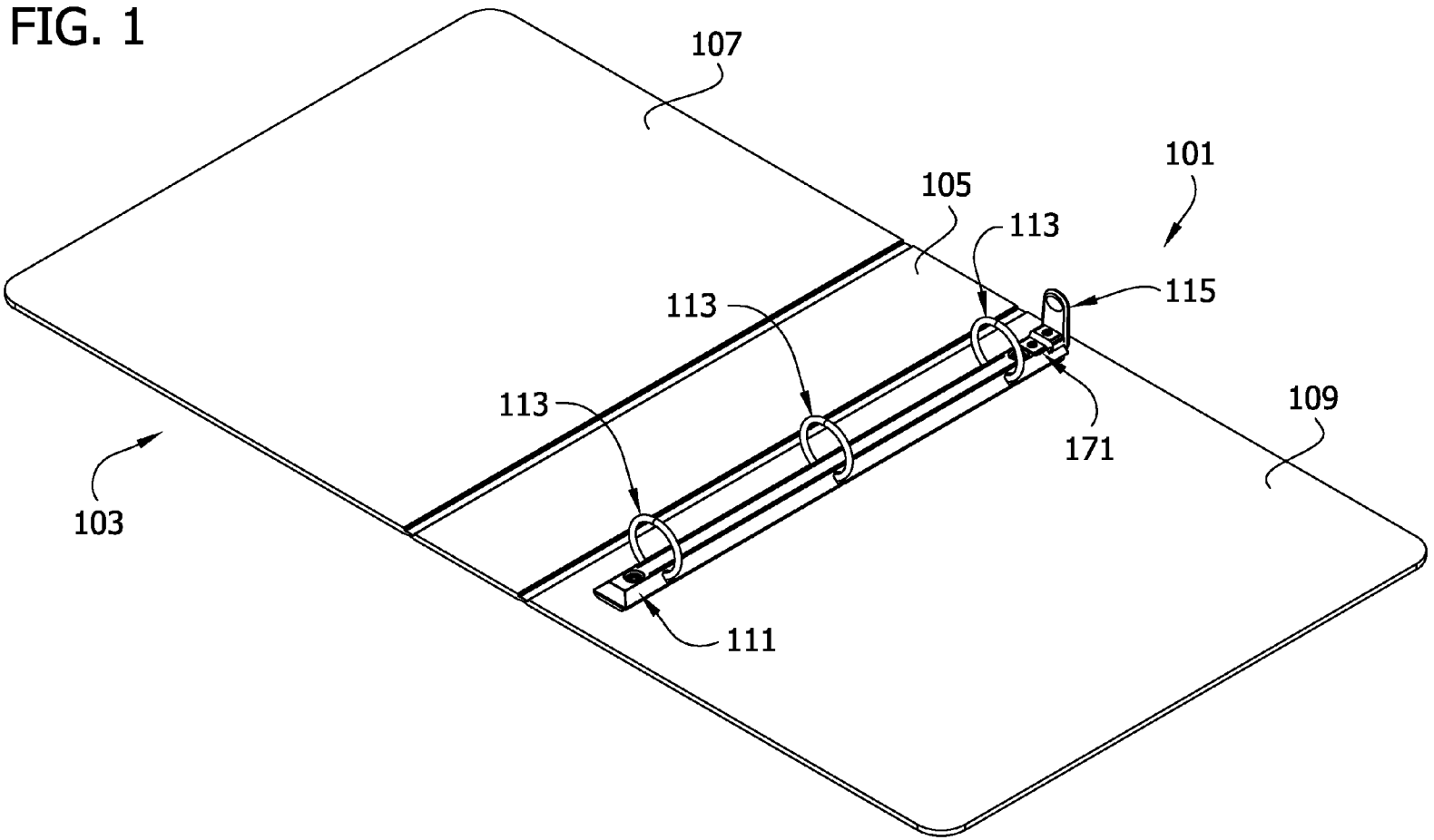
FIG. 1 is a perspective of a notebook and one embodiment of a ring binder mechanism secured to the notebook.
Figure 2:
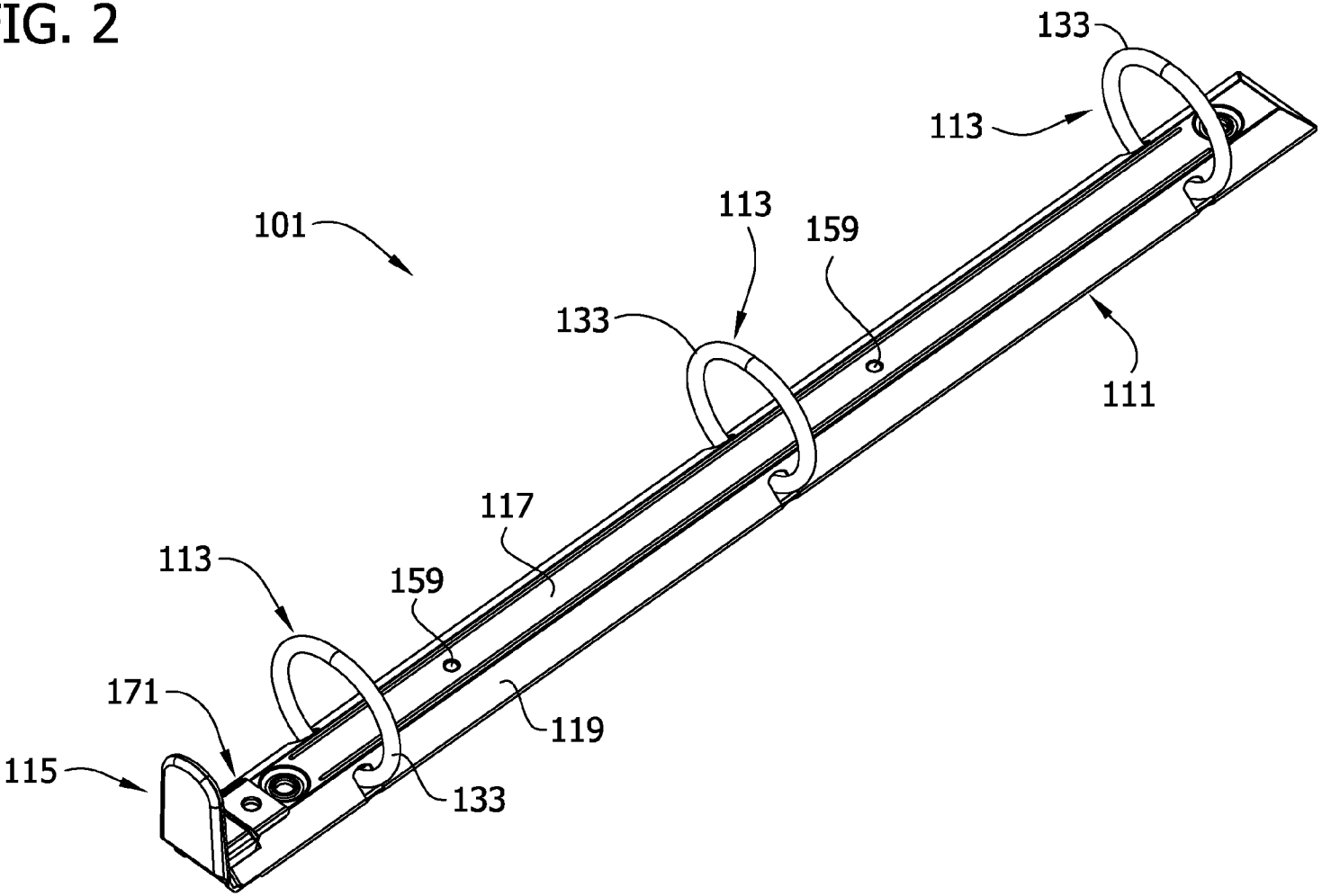
FIG. 2 is a perspective of the ring binder mechanism in a closed position.

Referring to the drawings, FIGS. 1-5 show an embodiment of a ring binder mechanism of the present invention, generally indicated at 101. In FIG. 1, the mechanism 101 is mounted on a notebook cover 103. Specifically, the mechanism 101 is mounted adjacent the spine 105 of the notebook cover 103. The spine 105 extends between front and back covers 107, 109 that are hingedly attached to the spine 105. The front and back covers 107, 109 are moveable to selectively cover or expose loose-leaf pages (not shown) retained by the mechanism 101. Ring binder mechanisms mounted on a notebook cover in other ways (e.g., on the spine) or on substrates other than a notebook cover (e.g., a file, a briefcase, etc.) do not depart from the scope of this invention.

As shown in FIGS. 2-5, the mechanism 101 includes an elongate housing 111 supporting a plurality of rings (each of which is designated generally 113). The housing 111 also has a raised flat central plateau 117 and sides 119 extending down and laterally outward from opposite sides of the plateau. The sides 119 of the housing are substantially parallel to one another. The plateau 117 and sides 119 give the housing a roughly arch-shaped cross-sectional shape. The flatness of the plateau 117 and sides 119 make the arch-shaped cross-sectional shape of the housing 111 illustrated in FIGS. 1 and 6 a segmented and angular arch shape. However, it is understood that the sides and central top portion of the housing can be more smoothly curved within the scope of the invention. In the illustrated embodiment, a first longitudinal end 121 of the housing 111 is generally open while a second, opposite longitudinal end 123 is generally closed. Bent under rims 125 extend lengthwise along the outer edge margins of the sides 119 of the housing 111. Mechanisms having housings shaped differently than the housing 111 illustrated in the drawings are within the scope of the invention.

The rings 113 are operable to retain loose-leaf pages on the ring mechanism 101 in the notebook 103. The ring mechanism 101 illustrated in the drawings has three rings 113. However, the number of rings can vary within the scope of the invention. The rings 113 shown in the drawings are substantially identical to one another and are each generally circular in shape. As shown in FIGS. 1-6, the rings 113 each include two ring members 133 (sometimes referred to and designated 133*a* and 133*b* to refer to a particular one of the ring members in a pair). The ring members 133 are suitably formed from a conventional, cylindrical rod of a suitable material (e.g., steel) having a circular cross-sectional shape. Ring binder mechanisms with ring members formed of different material or having different cross-sectional shapes (e.g., oval cross-sectional shapes) do not depart from the scope of this invention. The ring members 133 in the illustrated embodiment are generally semi-circular so the rings 113 have a generally circular shape, but the rings can have non-circular shapes within the scope of the invention. Further, one of the ring members can have a different shape from the other, such as is the case with D-shaped rings and other asymmetric rings.

At least one of the ring members 133*a* of each ring 113 is moveable relative to the housing 111 and the opposing ring member 133*b* between a closed position and an open position. In the ring mechanism 101 shown in the drawings, the two ring members 133*a*, 133*b* each move in a substantially similar way relative to housing 111 to open and close the rings 113, but this is not necessary to practice the invention. For example, one of the ring members of each ring could be fixed to the housing within the scope of the invention. In the closed position (FIG. 2) the ring members 133 form a substantially continuous, closed loop for allowing loose-leaf pages retained by the rings 113 to be moved along the rings from one ring member to the other. In the open position (FIG. 4) the ring members 133 form a discontinuous, open loop for adding or removing loose-leaf pages from the rings 113.

Figure 3:
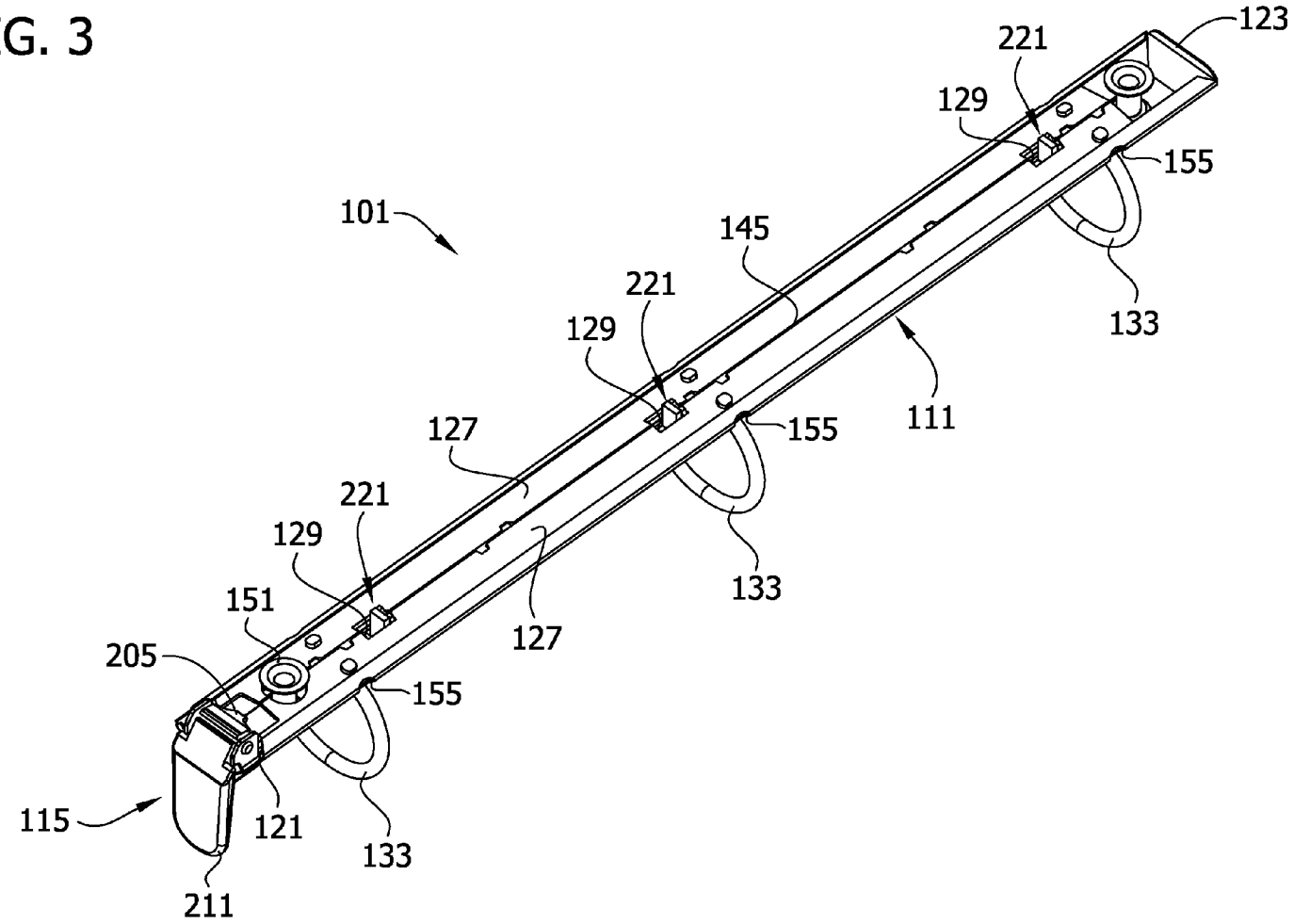
FIG. 3 is another perspective of the ring binder mechanism in the closed position taken from a different vantage point.
Figure 4:
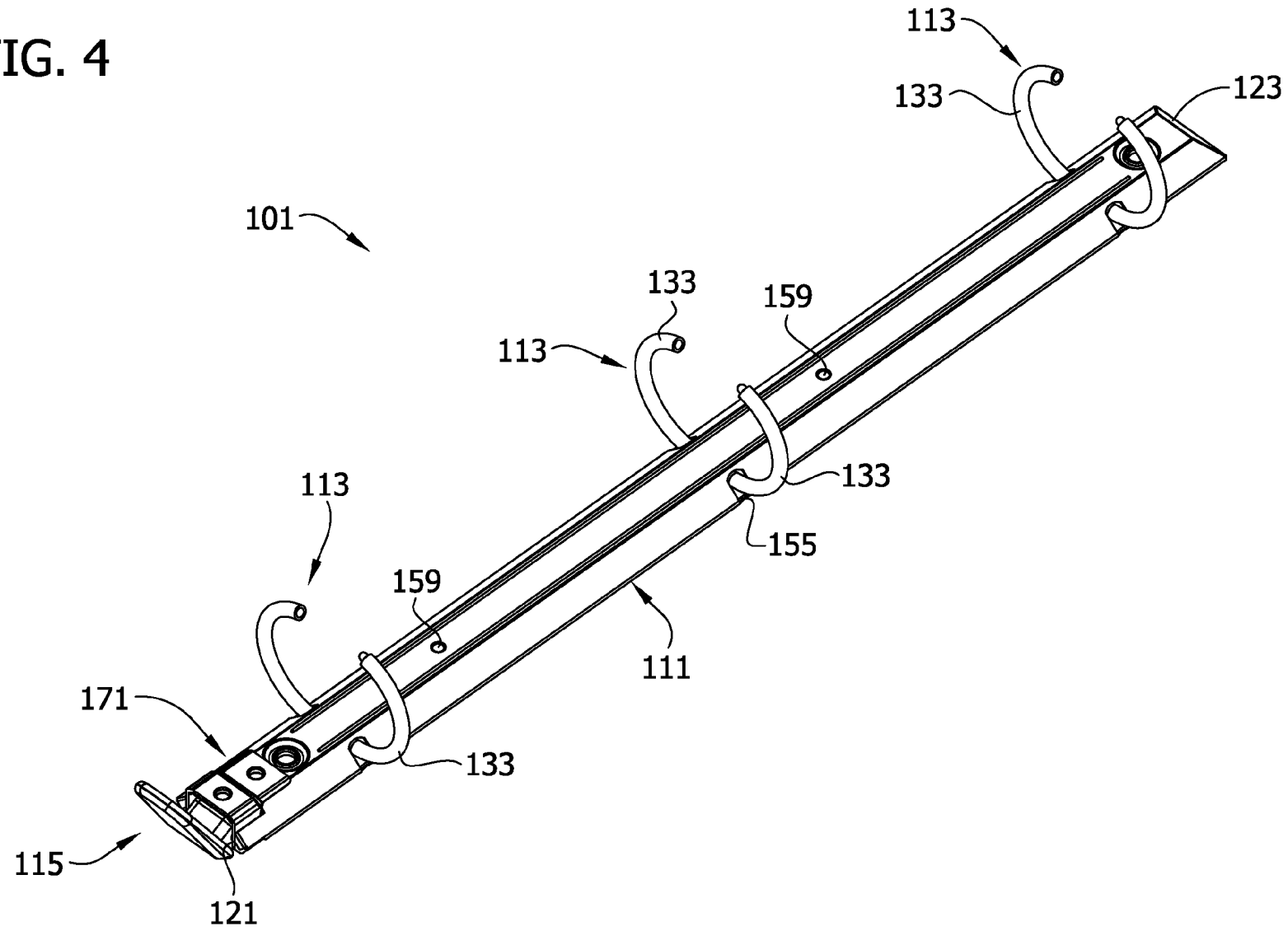
FIG. 4 is a perspective of the ring binder mechanism similar to FIG. 2 but showing the mechanism in an open position.
Figure 5:
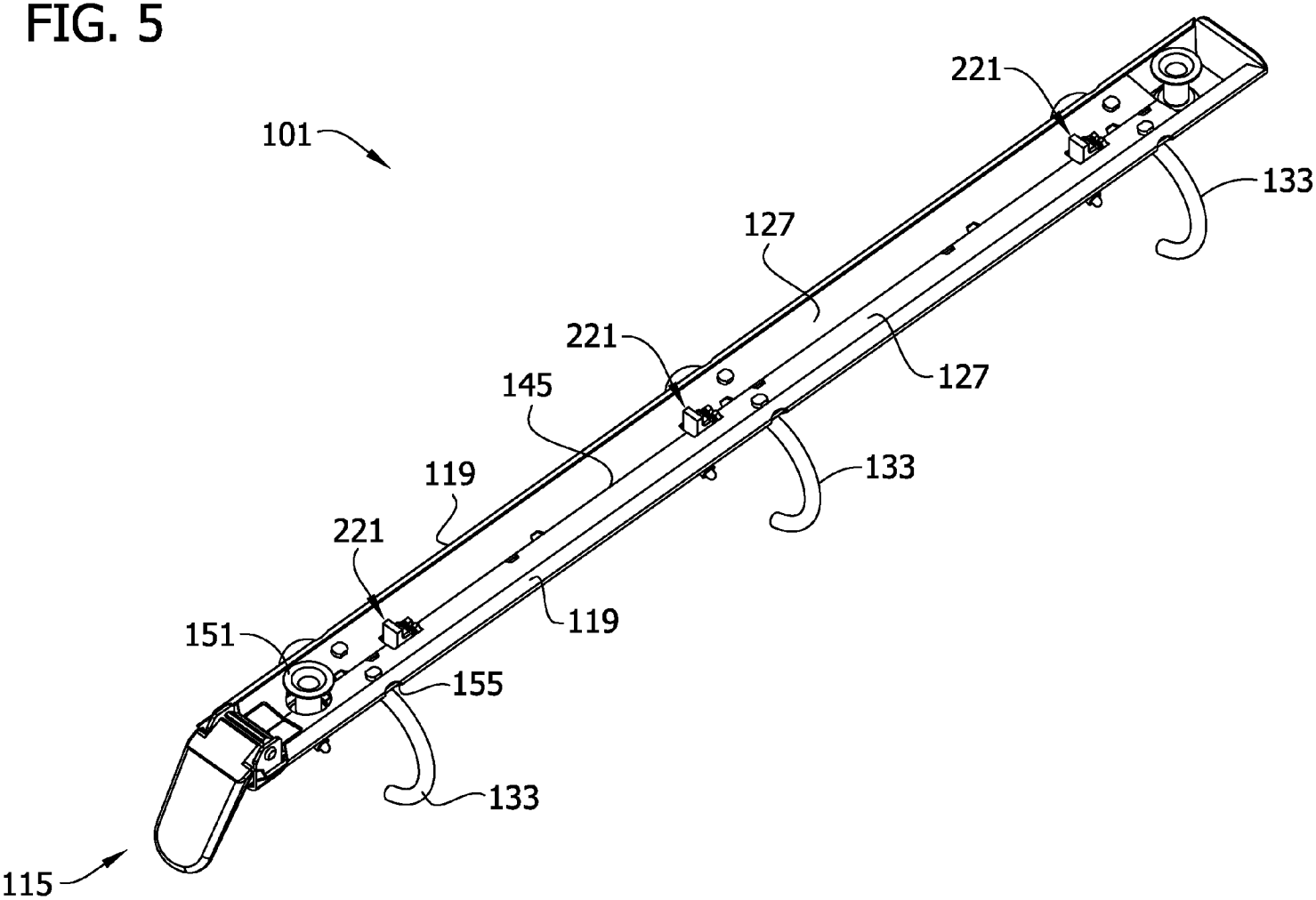
FIG. 5 is perspective of the ring binder mechanism similar to FIG. 3 but showing the mechanism in the open position.
Figure 6:
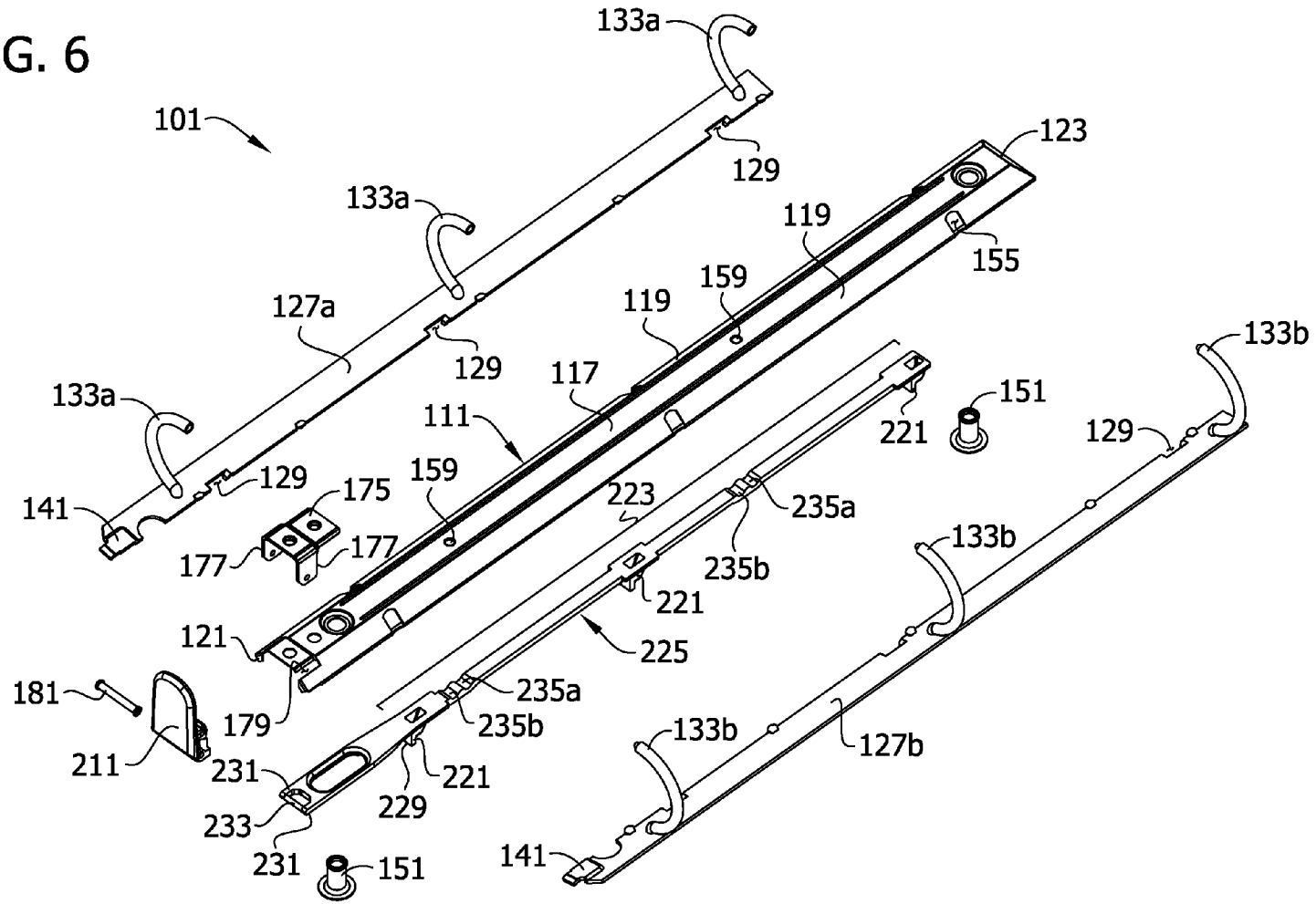
FIG. 6 is an exploded perspective of the ring binder mechanism.

The ring mechanism 101 includes two substantially identical hinge plates 127 supporting the ring members 133. The hinge plates 127 are each generally elongate, flat, and rectangular in shape and are each somewhat shorter in length than the housing 111. The hinge plates 127 are interconnected in parallel arrangement along their inner longitudinal edge margins (as illustrated in FIGS. 3 and 5), forming a central hinge 145 having a pivot axis. This is suitably done in a conventional manner known in the art. The outer longitudinal edge margins of the hinge plates 127 are received in the grooves formed by the bent under rims 125 of the housing 111, which thereby supports the hinge plates for pivoting within the housing. As shown in FIG. 6, the ring members 133*a*, 133*b* are each mounted in generally opposed fashion on respective ones of the hinge plates 127 (which are sometimes designated 127*a* and 127*b* to correspond with the designation of the respective ring member). The ring members 133 extend through respective openings 155 along the sides 119 of the housing 111 so that the free ends of the ring members engage one another above the housing when the rings 113 are closed. The ring members 133 are rigidly connected to the hinge plates 127 and move with the hinge plates when they pivot. In the ring binder mechanism 101 illustrated in the drawings, both ring members 133 of each ring 113 are mounted so they extend from the upper surfaces of the hinge plates 127. However, a mechanism in which one or more ring members are mounted so they extend from a lower surface of the hinge plate (e.g., as disclosed in commonly owned U.S. Pub. Pat. App. No. 20080008519) is also within the scope of the invention.

The hinge plates 127 can be pivoted downward and upward on the central hinge 145 relative to the housing 111 to move the ring members 133 mounted thereon between the closed position and the open position. The ring members 133 close when the hinge plates 127 pivot downward (i.e., the central hinge 145 moves away from the housing 111). The ring members 133 open when the hinge plates 127 pivot upward (i.e., the central hinge axis 145 moves toward the housing 111). The combined width of the hinge plates 127 is wider than the spacing between the bent under rims 125 of the housing 111 when the hinge plates are in a co-planar position. Consequently, as the hinge plates 127 pivot through the co-planar position, the hinge plates deform the housing 111 and create a spring force in the housing. The housing spring force biases the hinge plates 127 and rings 113 to remain closed when they are in the closed position and biases the hinge plates and rings to remain open when they are in the open position.

An actuator 115 is moveable relative to the housing 111 by a user to cause the pivoting motion of the hinge plates 127 against the spring force from the housing 111 to open and close the rings 113. The actuator 115 is rotatable between a first position (FIG. 11) in which the ring members 133 are in the closed position and a second position (FIG. 9) in which the ring members are in the open position.

In the illustrated embodiment, the actuator 115 is mounted for pivoting movement relative to the housing between the open and closed positions on a lever mount 171 (FIG. 6) formed separately from the housing 111 and secured to the housing (e.g., by one or more rivets or other suitable fasteners). The lever mount 171 includes a plate 175 positioned on top of the housing plateau 117 at the open end 121 of the housing 111. The lever mount 171 also has arms 177 extending from opposite sides of the plate 175 into the housing 111 through slots 179 at the end 121 of the housing. The actuator 115 is pivotally connected to the lever mount by a pivot pin 181 extending through the actuator and retained by the arms of the lever mount. Thus, the actuator 115 is pivotal about a pivot axis coincident with the pin 181. The lever mount 171 does not extend longitudinally beyond the open end 121 of the housing 111. Also, only a relatively minor portion of the actuator 115 extends longitudinally beyond the open end 121 of the housing 111 when the rings are closed. Other ways of mounting the actuator, including directly to the housing without a separate lever mount, do not depart from the scope of the invention.

Figure 8:
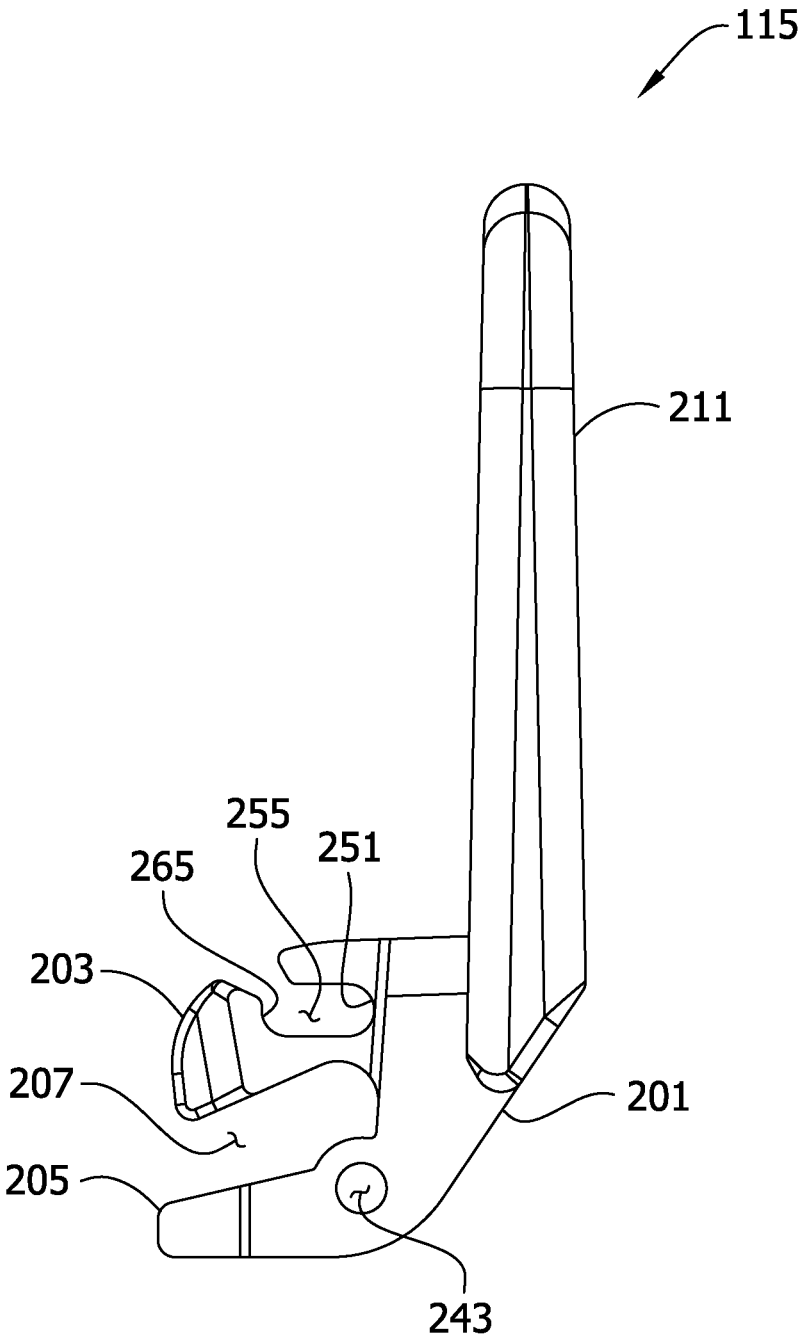
FIG. 8 is a side elevation of one embodiment of an actuator of the ring binder mechanism.
Figure 9:
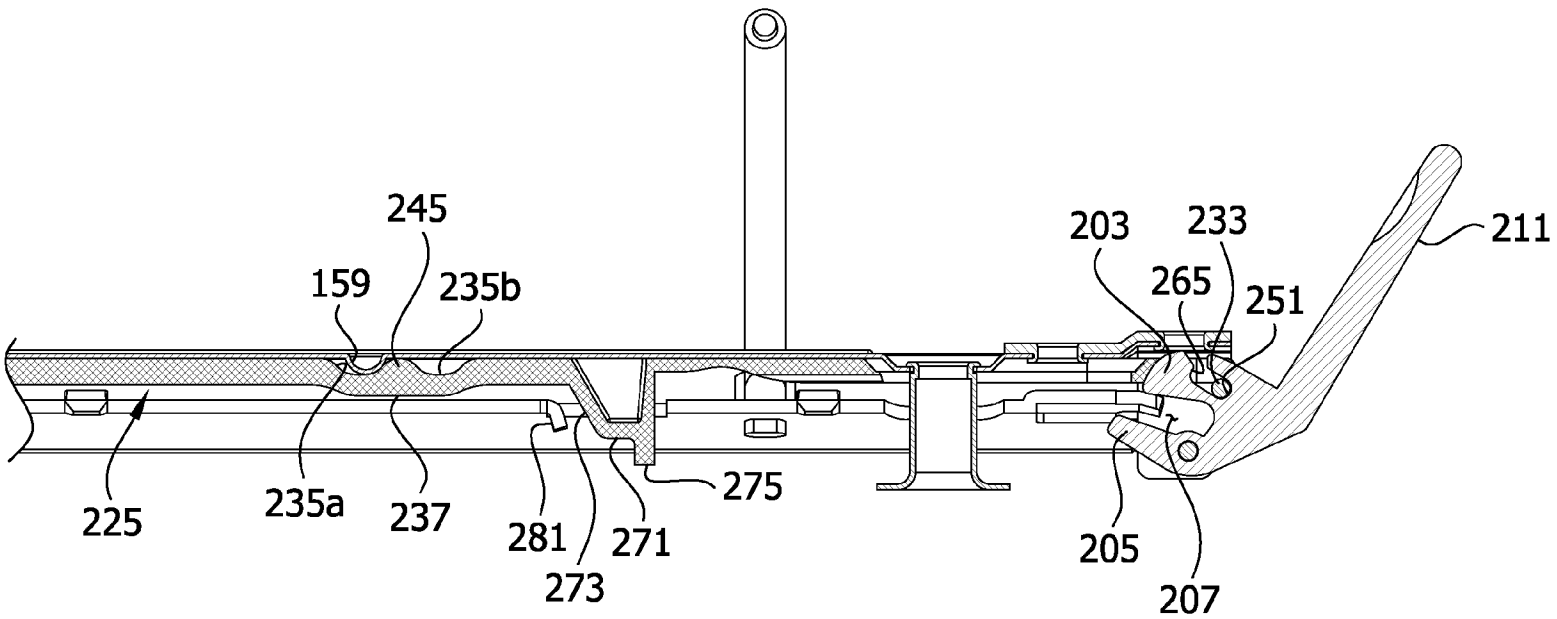
FIG. 9 is an enlarged fragmentary section of a portion of the ring binder mechanism in the open position.

Referring now to FIGS. 8-11, the actuator 115 has a body 201 and a closing arm 203 extending from the body. The closing arm 203 is positioned to pivot the hinge plates 127 and move the rings 113 to the closed position when the actuator is moved from the open position to the closed position. The actuator 115 also has an opening arm 205 extending from the body 201 and positioned to pivot the hinge plates 127 and move the rings 113 to the open position when the actuator is moved from the closed position to the open position. As seen in FIGS. 8 and 9, the closing and opening arms 203, 205 form a channel 207 in which the ends of the hinge plates 127 are received. A handle 211 extends from the body 201 of the actuator 115 to facilitate movement of the actuator by a user between the open and closed position. The handle of the actuator can have many different shapes within the scope of the invention.

The ends of the hinge plates 127 are received in the channel 207 so the closing arm 203 is above the ends of the hinge plates and the opening arm 205 is below the ends of the hinge plates. Each of the hinge plates 127 has a relatively narrow finger 141 (FIG. 6) extending longitudinally toward the open end 121 of the housing 111. The fingers 141 are each narrower in width than the respective hinge plates 127 and are positioned so their inner longitudinal edges are generally aligned with the inner longitudinal edges and central hinge 145 of the hinge plates. When the actuator 115 is moved from the closed position to the open position, the opening arm 205 applies an upward force to the fingers 141 of the hinge plates, which pivots the central hinge 145 upward to open the rings 113. Likewise, when the actuator is moved from the open position to the closed position, the closing arm 203 applies a downward force to the fingers 141, which pivots the central hinge 145 downward to close the rings 113. Suitably, the opening arm 205 is in constant contact with the hinge plates 127.

In addition to opening and closing the rings 113 as described above, the actuator 115 is also adapted to move a locking element 221 between a locking position (FIG. 11) and a non-locking position (FIG. 9) as the actuator is moved between its open and closed positions to open and close the rings 113. In the locking position, the locking element 221 prevents movement of the rings 113 from the closed position to the open position by blocking the pivoting motion of the hinge plates 127. In the non-locking position, the locking element 221 does not block movement of the hinge plates 127 and rings 113 from the closed position to the open position. Suitably, the actuator 115 deforms the hinge plates 127 while the locking element 221 is moved out of the locking position to sequence movement of the locking element and the hinge plates.

Figure 7:
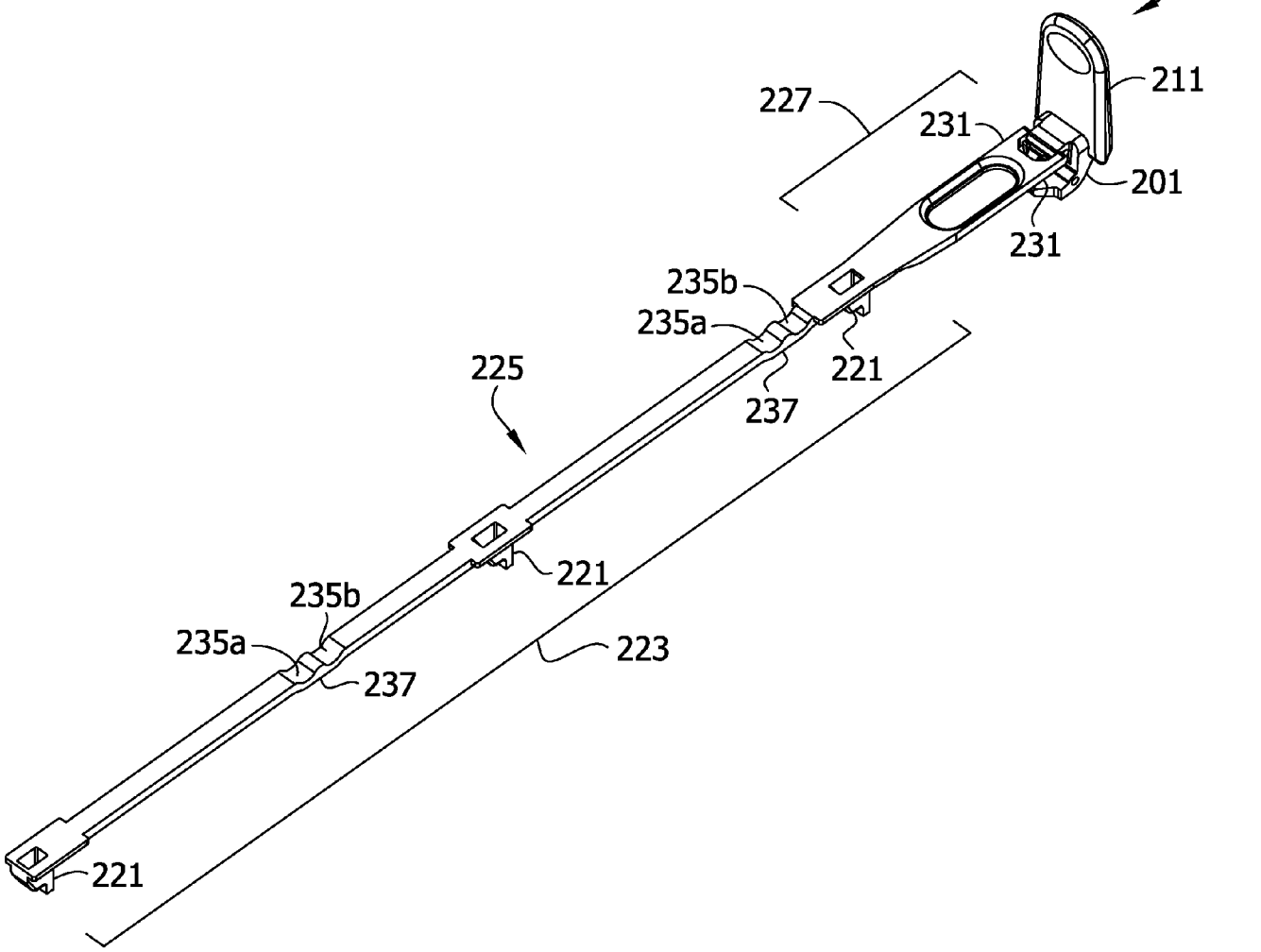
FIG. 7 is a perspective of one embodiment of a travel bar of the ring binder mechanism.
Figure 10:
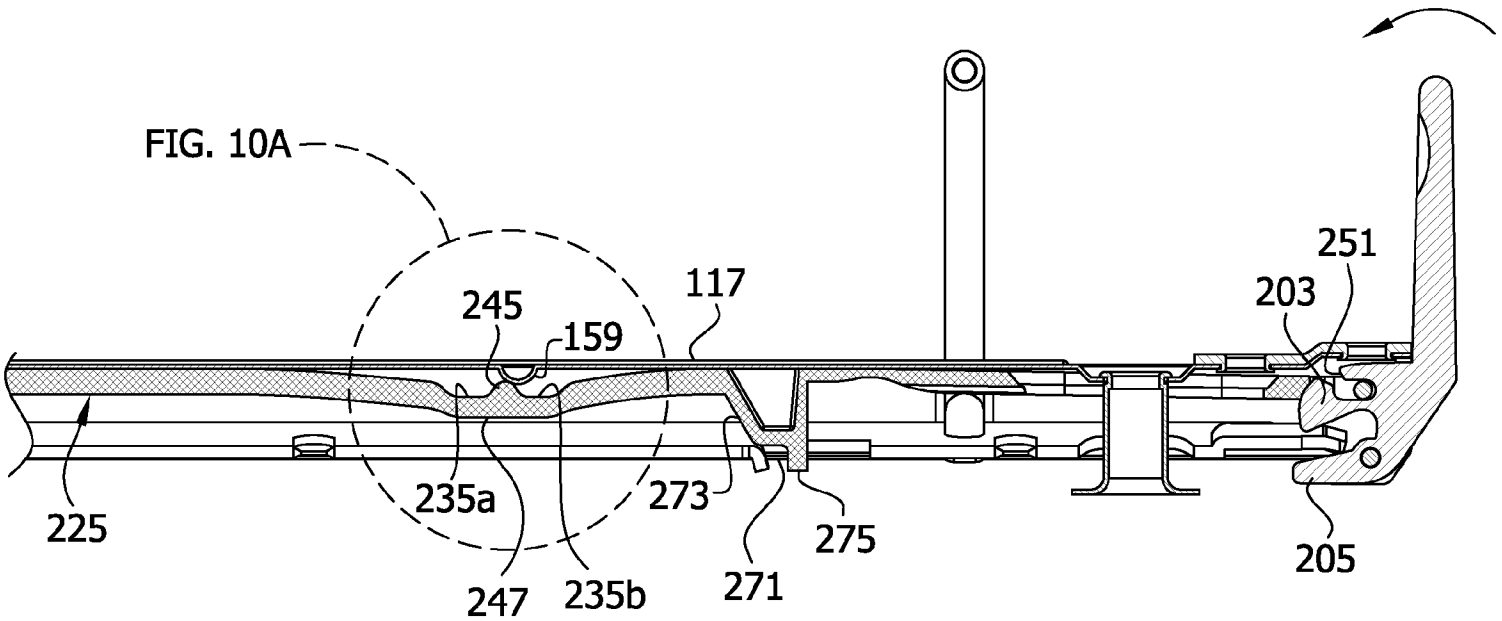
FIG. 10 is an enlarged fragmentary section of a portion of the ring binder mechanism in a position between the open and fully closed positions.
Figure 10A:
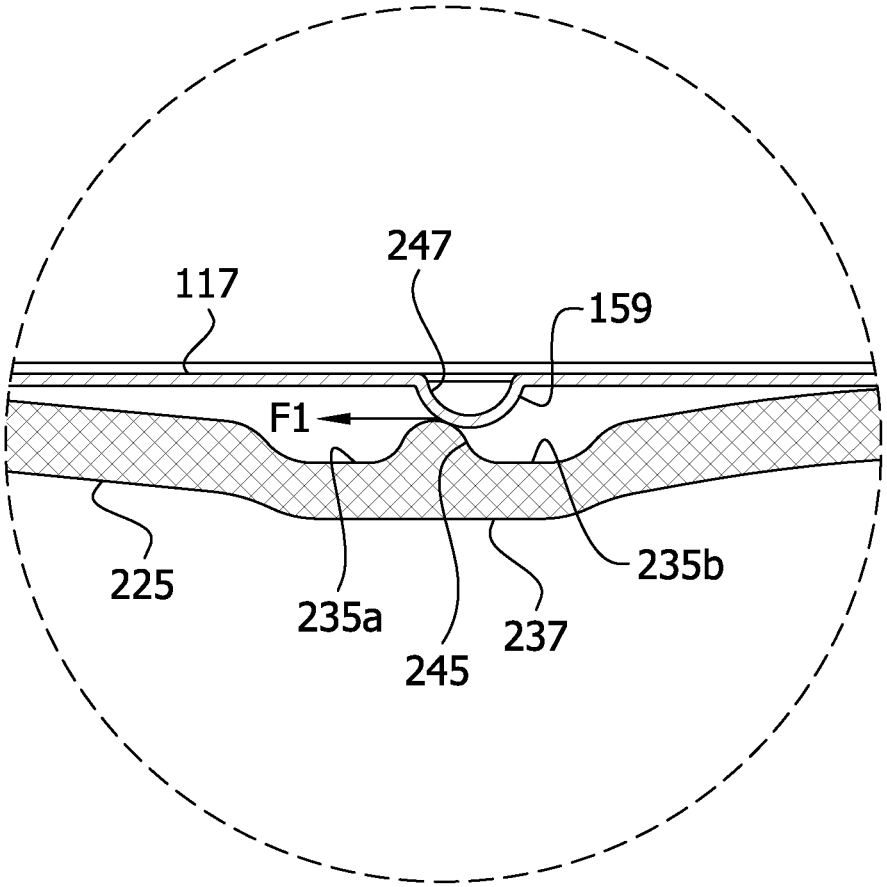
FIG. 10A is an enlarged fragmentary section of the ring mechanism showing the portion of the mechanism indicated on FIG. 10.
Figure 11:
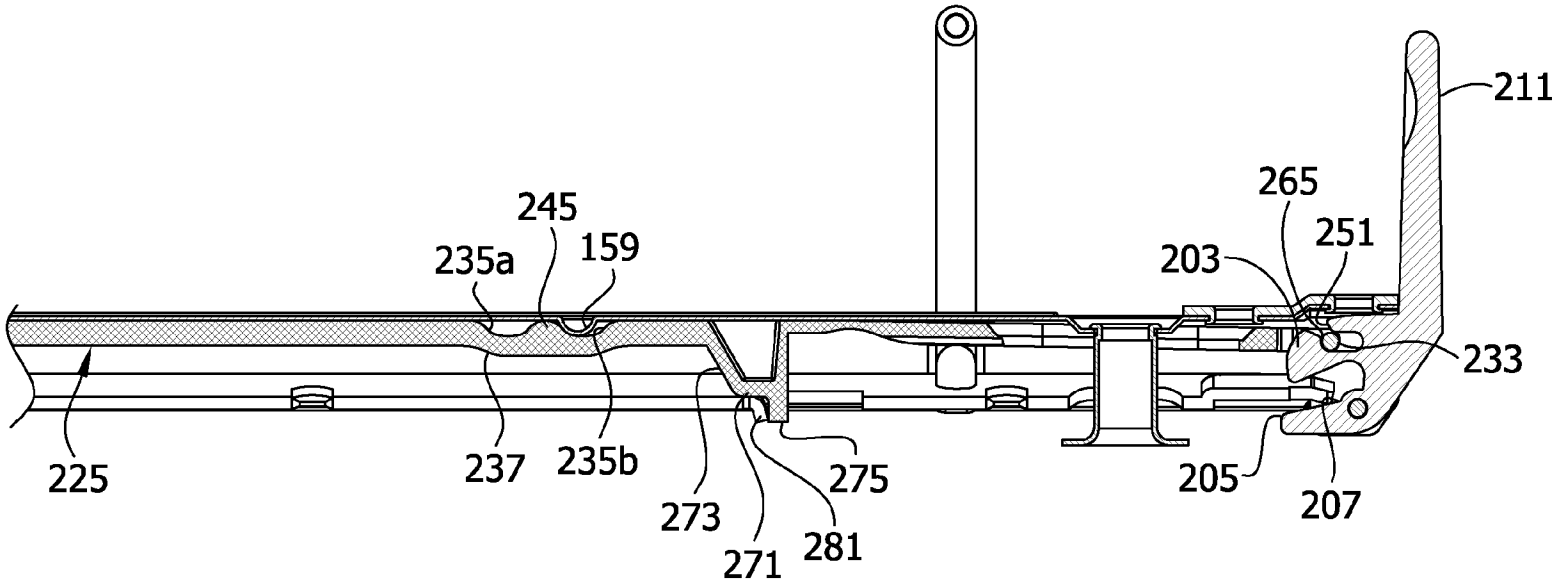
FIG. 11 is an enlarged fragmentary section of a portion of the ring binder mechanism in the closed position.

As illustrated in FIG. 7, the locking element 221 is one of three substantially identical locking elements (each of which is designated 221) on a locking portion 223 of a travel bar 225, which extends longitudinally in the housing 111 between the hinge plates 127 and the plateau 117 of the housing. The number of locking elements can vary without departing from the scope of the invention. The locking elements 221 are spaced apart longitudinally along the locking portion 223 of the travel bar 225 with one locking element adjacent each longitudinal end of the locking portion 223 of the travel bar, and one located toward a center of the locking portion of the travel bar. The locking elements 221 protrude from the locking portion 223 of the travel bar 225 toward the hinge plates 127. As shown in FIGS. 9-11, each locking element 221 includes a flat bottom 271, an angled forward edge 273, and a rearward extension 275. The angled edges 273 of the locking elements 221 may engage the hinge plates 127 and assist in pivoting the central hinge 145 of hinge plates down during closing. In the illustrated embodiment, the locking elements 221 are formed integrally as one piece of material with the travel bar 225 by, for example, an injection molding process. But the locking elements may be formed separately from the travel bar and attached thereto without departing from the scope of the invention. Additionally, locking elements with different shapes, for example, block shapes (e.g., no angled edges), are within the scope of this invention. The travel bar 225 and locking elements 221 may be broadly referred to as a "locking system."

Cutouts 129 (FIGS. 3 and 6) are formed in each of the hinge plates 127 along an inner edge margin of the plate. The cutouts 129 in each of the individual hinge plates 127 align to form four openings (also designated 129) along the central hinge 145 of the interconnected hinge plates, as best illustrated in FIG. 3. A mounting post 151 passes through one of the openings 129 in the hinge plates 127 proximal to the open end 121 of the housing 111. The three other openings 129 are positioned axially along the central hinge axis 145 of the hinge plates 127 in proximity to the locking elements 221. In particular, the openings 129 are positioned so they are in registration with the locking elements 221 when the travel bar 225 is in the non-locking position (FIG. 9) and so they are out of registration with the locking elements when the travel bar is in the locking position (FIG. 11). As illustrated in FIG. 11, when the travel bar 225 is in the locking position, the flat bottoms 271 of the locking elements 221 engage the upper surfaces of the hinge plates 127 at the edges of the openings 129 and thereby block pivoting movement of the hinge plates toward their open position.

A connector portion 227 of the travel bar 225 connects the locking portion 223 of the travel bar to the actuator 115. The connector portion 227 of the travel bar 225 is suitably attached to the locking portion 223 by a hinge 229 (e.g., a living hinge) that allows pivoting movement of the connector portion relative to the locking portion to facilitate conversion of the motion of the connector portion, which can be driven by the actuator 115 in a manner than includes some rotation, to linear movement of the locking portion of the travel bar. The hinge 229 suitably has greater flexibility than the connector portion 227 of the travel bar 225, for example due to construction of the hinge as a segment of the travel bar that has a reduced thickness compared to the connector portion 227.

Referring to FIGS. 6 and 7, the end of the connector portion 227 of the travel bar 225 opposite the hinge 229 is at the open end 121 of the housing. The end of the connector portion 227 has arms 231 extending longitudinally of the housing 111 toward the open end 121 and a cross bar 233 at the end of the travel bar 225 and extending between the arms. The cross bar 233 is captured by the actuator 115 so movement of the actuator between the open and closed positions produces movement of the cross bar 233 at the end of the travel bar 225.

Referring to FIGS. 8-11, there is a slot or recess 255 in which the cross bar 233 at the end of the travel bar 225 can be captured, as illustrated in FIG. 8. In the illustrated embodiment, the recess 255 is between the closing arm 203 and the handle 211. When the cross bar 233 of the travel bar 225 is captured in the recess 255 by the actuator 115, the cross bar extends through the recess from one side of the actuator to the opposite side of the actuator. A portion of the recess is defined by a concave surface 265 shaped to generally conform to the shape of the cross bar 233 to facilitate seating of the cross bar against the concave surface during opening. Another portion of the recess is defined by a concave surface 251 shaped to generally conform to the shape of the cross bar 233 to facilitate seating of the cross bar against the surface during closing.

The travel bar 225 and actuator 115 are adapted so the cross bar 233 can be snapped into the recess 255 during assembly of the ring mechanism 101 by moving the cross bar relative to the actuator in a direction (e.g., generally downward) that is generally perpendicular to the longitudinal axis of the cross bar. This can be advantageous because it facilitates use of a travel bar 225 in which the cross bar 233 is formed integrally as one piece with the rest of the connector portion 227. It can also be advantageous because there is no need for precise alignment and insertion of various components into other components, as would be the case if assembly of the travel bar and actuator required a pin or other elongate structure to be inserted longitudinally into an opening that is about the same size as the structure to be inserted therein. This simplifies assembly of the ring mechanism 101.

It is envisioned that the entire actuator 115 (except for an optional cushion, not shown, that may cover some or all of the handle 211) is formed integrally as one piece (e.g., from a resilient moldable polymeric material). However, the actuator 115 may be formed from other materials or by other processes within the scope of this invention. For example, an actuator made of components formed separately and assembled to produce an actuator is within the scope of the invention. A ring mechanism having an actuator shaped differently than illustrated and described herein does not depart from the scope of the invention.

In addition to the locking elements 221, the locking portion 223 of the travel bar 225 also includes retaining formation 239 configured to engage a corresponding retaining formation 241 on the housing 111. The retaining formations 239, 241 are configured to help retain the travel bar 225 in the locking position when the rings 113 are closed and retain the travel bar in the non-locking position when the rings are open. The retaining formations 239, 241 also provide tactile and audible feedback to a user manipulating the actuator 115 indicating that the movement of the actuator between the open and closed positions is complete. Further, the retaining formations 239, 241 in the illustrated embodiment can be used to apply tension to the travel bar when the rings are closed to pull the actuator all the way to its closed position as the rings 113 are closed.

In the illustrated embodiment, the travel bar 225 and housing 111 each include a pair of substantially identical retaining formations 239, 241, respectively, spaced longitudinally from one another. For example, at least one of the locking elements 221 on the travel bar 225 is suitably positioned between the two retaining formations 239 on the travel bar. Similarly, at least one ring 113 is suitably positioned between the retaining formations 241 on the housing 111. Although the travel bar 225 and housing 111 in the illustrated embodiment each have a pair of retaining formations 239, 241, it is understood the travel bar and housing could each include only a single retaining formation within the broad scope of the invention. Moreover, the travel bar and housing can also include more than two retaining formations within the broad scope of the invention.

Because the retaining formations 239, 241 in the illustrated embodiment are substantially identical, a detailed description of one set of cooperating retaining formations 239, 241 will suffice to describe them all. As seen in FIGS. 9-11, the retaining formation 241 on the housing 111 suitably includes a detent 159 extending downward from plateau 117 of the housing toward the travel bar 225 and toward the hinge plates 127. The detent 159 can be formed integrally with the housing 111, as illustrated, or it can be made from a separate piece that is secured to the housing within the scope of the invention. As shown in FIGS. 9-11, the detent 159 is a generally rounded protrusion (e.g., a dimple) extending downward from the housing. However, detents having different shapes such as convex shapes having angled edges (e.g., not rounded), are within the broad scope of this invention.

The retaining formation 239 on the travel bar 225 suitably includes a recess 235 on the upper surface of the travel bar positioned to receive the detent 159 when the travel bar 225 is in the locking position. As illustrated in FIG. 7, the retaining formation 239 on the travel bar 225 includes a pair of recesses 235 including a first recess 235*a* and a second recess 235*b*. The second recess 235*b* is positioned closer to the actuator 115 than the first recess 235*a*. When the actuator 115 is in the closed position (FIG. 11), the detent 159 of the housing 111 is received in the second recess 235*b*. When the actuator is in the open position (FIG. 9), the detent 159 of the housing 111 is received in the first recess 235*a*. The recesses 235 are spaced from the locking elements 221. Each recess 235 is suitably generally rounded, although other shapes are within the scope of the present invention.

As illustrated in FIG. 7, travel bar 225 includes a bump 237 extending down from its underside at the location of each retaining formation 239. Thus, in the illustrated embodiment in which there are two retaining formations 239 on the travel bar, there are two substantially identical bumps 237 extending down from the underside of the travel bar 225 at the locations of the retaining formations. The bump 237 provides additional thickness in the travel bar 225 so the travel bar is not too thin at the locations of the recesses 235 of the retaining formation 239.

The retaining formation 239 on the travel bar also includes a protrusion 245 separating the first recess 235*a* from the second recess 235*b*. The protrusion 245 forms the bottom portions of the adjacent sides of the recesses 235. An apex 247 of the protrusion 245 is suitably generally level with the upper surface of the remainder of the travel bar 225 adjacent the recesses 235 (FIG. 9). The travel bar 225 is adapted so it can resiliently flex away from the housing 111 at the retaining formation 239, as illustrated in FIG. 10, when the protrusion 245 is aligned with the detent 159 and the detent is not received in either of the recesses 235 as the travel bar is moved between the open and closed positions. The detent 159 and protrusion 245, as well as the adjacent portions of the bottoms of the recesses 235 formed by the protrusion, are adapted so the retaining formations 239, 241 exert forces on one another tending to resist movement of the travel bar 225 away from the closed and locked position when it is in that position. The detent 159, protrusion 245, and adjacent bottom portions of the recesses 235 are also adapted so the retaining formations 239, 241 exert forces on one another tending to resist movement of the travel bar 225 away from the open position when it is in that position.

In particular, in the illustrated embodiment, the inclined surfaces forming the adjacent edges of the recesses 235 and forming the sides of the protrusion 245 are urged by elastic restoration forces in the flexed travel bar 225 against inclined surfaces of the detent 159 to produce a force tending to move the travel bar toward a position in which the detent 159 is received in whichever of the recesses 235*a* or 235*b* is closer to being in registration with the detent. As illustrated in FIG. 10, for example, the retaining formations 239, 241 are configured so the interaction between the detent 159 and the protrusion 245/bottom of recess 235*b* produces a force F1 tending to move the travel bar 225 toward the closed and locked position as the travel bar approaches the closed and locked position during closing of the rings 113. The force F1 is also transmitted through the travel bar 225 to the actuator 115, which tends to rotate the actuator toward its closed position.

As illustrated in FIG. 11, once the detent 159 is received in the recess 235*b*, the interaction between the detent 159 and the protrusion 245/bottom of the recess 235*b* helps hold the travel bar in the locking position. When the travel bar 225 is in the locked position, the actuator 115 may be maintained in slight tension by the interaction between the retaining formations 239, 241. This can help reduce or eliminate play in the actuator 115 when the rings are closed. For example, in FIG. 11 the detent 159 is positioned to maintain contact with the protrusion 245 when the rings 113 are closed so the retaining formations 239, 241 can produce tension in the travel bar 225. Alternatively, the recess 235*b* can be sized and/or positioned relative to the detent 159 so there is no tension produced by the retaining formations when the rings are closed. For instance, there can be a small gap between the detent 159 and the protrusion 245 when the rings 113 are closed within the scope of the invention. Yet, even if there is no tension in the travel bar 225 when the rings 113 are closed, after the travel bar has been moved away from the locking position the retaining formations 239, 241 produce a force tending to resist movement of the travel bar farther away from the locking position. The force resisting movement of the travel bar 225 away from the locked position also resists movement of the actuator 115 toward its open position and returns the actuator and travel bar to the closed/locked position in the event of slight (e.g., unintentional) movement of the actuator away from the closed position.

Referring to FIG. 9, when the rings 113 are open, the detent 159 is received in the other recess 235*a* of the retaining formation 239. As illustrated, the retaining formations 239, 241 on the travel bar 225 and housing 111 interact with one another to help hold the travel bar, actuator 115 and rings in the open position.

Moreover, the retaining formations 239, 241 are suitably adapted to provide feedback to a user manipulating the actuator 115 indicating to the user that the actuator 115 and travel bar has completed movement from the closed position to the open position and/or completed movement from the open position to the closed position. The feedback can be in the form of an audible sound and/or a tactile sensation associated with movement of the protrusion 245 past the detent 159. The audible sound can be a snapping sound that occurs as the detent 159 is snapped into one of the recesses. Similarly, the retaining formations 239, 241 are configured to reverse the direction of the force applied to the travel bar as the protrusion 245 slides past the detent 159 during movement between the open and closed positions, which creates a tactile sensation that can be perceived by a user manipulating the actuator 115. Further, the amount of force exerted on the travel bar 225 as a result of the interactions between the retaining formations 239, 241 can drop off perceptibly as the detent 159 is received in one of the recesses 235. Although it is contemplated that the tactile and/or audible feedback may be desirable, it is understood that feedback is not essential and retaining formations that do not produce any tactile or audible feedback are within the scope of the invention.

As illustrated, the entire travel bar 225 (including the locking elements 221, locking portion 223, bump 237, recesses 235, protrusion 245, hinge 229, and connector portion 227) is suitably formed integrally as a single unitary piece of a moldable polymeric material. However, it is understood that various components of the travel bar may be made manufactured separately and assembled to form a non-unitary travel bar within the scope of the invention.

Operation of the ring mechanism 101 will now be described with reference to FIGS. 9-11. In FIG. 11, the ring mechanism 101 is in a closed and locked position. The hinge plates 127 are hinged downward, away from housing 111, so that the ring members 133 of each ring 113 are together in a continuous, closed loop, capable of retaining loose-leaf pages. The handle 211 of the actuator 115 is substantially vertical relative to the housing 111 (when oriented as illustrated in FIG. 11) and abuts the open end 121 of the housing. The locking elements 221 of the travel bar 225 are positioned above the hinge plates 127 and adjacent their respective openings 129, but out of registration with the openings 129. The flat bottom surfaces 271 of the locking elements 221 abut upper surfaces of the hinge plates 127. The rearward extensions 275 of the locking elements 221 extend through each respective opening 129 adjacent forward, downturned tabs 281 of the hinge plates 127. Each of the detents 159 of the retaining formations 241 on the housing 111 are received in the corresponding second recess 235*b* of the corresponding retaining formations on the travel bar 225.

Any event, such as a force inadvertently applied to rings 113 or the actuator 115 when the ring mechanism is dropped, that would tend to move the travel bar 225 out of its locking position produces interaction between the retaining formations 239, 241 that resists movement of the travel bar away from the locking position. In the illustrated embodiment, the detent 159 and the protrusion 245 interact with one another to produce a force F1 (see FIG. 10) urging the travel bar 225 away from the actuator 115 and back toward its locking position.

To unlock the ring mechanism 101 and open the rings 113 a user rotates the actuator 115 so the handle 211 rotates away from the plateau 117 of the housing, which pulls the cross bar 233 and travel bar 225 away from the locking position toward the non-locking position (FIG. 9). While the locking system 221, 225 is being moved to the non-locking position by the actuator 115, the upward pivoting movement of the hinge plates 127 at the central hinge 145 is resisted by the engagement of locking elements 221 with the upper surfaces of the hinge plates. The hinge plates 127 deform at their ends adjacent the actuator 115 to delay pivoting movement of the hinge plates until the locking elements 221 have been moved into registration with the openings 129 in the hinge plates.

As the travel bar 225 is moved by the closing arm 203, the detent 159 engages the protrusion 245 and produces a force F1 (FIG. 10) that resists further movement of the travel bar and which is transmitted through the travel bar to the actuator 115 and which thereby resists continued rotation of the actuator toward the open position. The user may continue to rotate the actuator 115 and overcome the resistance provided by the retaining formations 239, 241. As the travel bar 225 continues to move farther from the locking position apex 247 of the protrusion 245 approaches alignment with the detent 159 and the travel bar flexes away from the plateau 117 of the housing in the vicinity of the retaining formation 239 to permit the protrusion to slide past the detent 159. Once the apex 247 of the protrusion 245 is aligned with the detent 159, the retaining formations 239, 241 no longer produce any forces resisting movement of the travel bar 225 away from its locking position.

When the locking system 221, 225 no longer blocks pivoting movement of the hinge plates 127, continued rotation of the actuator 115 by the user rotates the opening arm 205 and pushes the central hinge 145 of the hinge plates 127 upwardly until the hinge plates are in the co-planar position (not shown). The hinge plates 127 suitably reach the co-planar position after the apex 247 of the protrusion 245 has already moved past the detent 159, although this is not essential. Once the hinge plates 127 move past their co-planar position, the direction of the housing spring force is reversed due to the toggling action of the hinge plates as they move through the co-planar position. Then, the housing 111 and/or actuator 115 move the hinge plates to their open position. Similarly, once the apex 247 of the protrusion 245 slides past the detent 159 on the housing, the direction of the forces produced by interaction of the retaining formations 239, 241 is reversed and the detent pushes the travel bar 225 toward the actuator 115 as the detent is received in the recess 235*a*. This allows the elastic restoration forces in the travel bar to return the travel bar to a less flexed configuration.

When upward pivoting movement of the hinge plates 127 is complete and the detent 159 is received in the recess 235*a*, the rings 113 are in the open position (as illustrated in FIG. 9). While the rings 113 remain in the open position, the interaction between the retaining formations 239, 241 helps hold the travel bar 225 and actuator 115 in the open position. This can help limit play in the actuator 115 while the rings are open.

To close and lock the rings 113, a user can simply grip one or more of the ring members 133 directly and move the ring members from the open position to the closed position. This action by the user will cause the central hinge 145 of the hinge plates to pivot downward in the housing 111 and rotate the actuator 115 to the closed position by pushing down on the opening arm 205. After the hinge plates 127 have pivoted out of the way, the actuator 115 pushes the travel bar and locking elements 221 to the locking position. The retaining formations 239, 241 suitably resist initial movement of the rings toward the closed position due to interaction between the protrusion 245 and detent 159. Similarly, the housing spring force also resists initial movement of the ring members toward the closed position until the direction of the housing spring force is reversed as the hinge plates 127 pass through their co-planar position. As the travel bar is pushed to the locking position (FIG. 10), the protrusion 245 slides across the detent 159 and the travel bar flexes away from the plateau 117 until the apex 247 of the protrusion is in alignment with the detent. The apex 247 of the protrusion suitably has already moved past the detent 159 at the time the hinge plates reach the co-planar position, although this is not essential. Once the apex 247 slides past the detent 159, the direction of the forces produced by the retaining formations 239, 241 is reversed. In particular, the retaining formations 239, 241 each produce a force F1 (FIG. 10) that urges the travel bar 225 to continue moving toward the locked position. As the travel bar 225 arrives at its locking position, the detent is received in the second recess 235*b*. When the detent 159 snaps into the second recess 235*b*, feedback (e.g., an audible sound, a tactile sensation) is produced to provide feedback to the user helping to confirm that closing is complete and the rings 113 are locked.

The user also has the option of using the actuator 115 to close and lock the rings 113 instead of manually moving the ring members 133 to close the rings. To close the rings 113 using the actuator 115, the user rotates the actuator in the reverse direction compared to the opening sequence. For example, the actuator 115 can be rotated (counter-clockwise as illustrated in FIG. 10) to move the handle 211 toward the plateau 117 of the housing 111. When rotation of the actuator 115 toward its closed position begins, the closing arm 203 pushes down on the central hinge 145 of the hinge plates 127 and initiates pivoting movement of the hinge plates toward the closed position. As the user continues to rotate the actuator 115 toward the closed position, the actuator pushes the travel bar 225 and locking elements 221 thereon toward the locking position. If the forward edges 273 of the locking elements 221 are not already seated against the hinge plates 127 at the edge of the respective openings 129 when closing movement of the actuator 115 begins, they are so seated by the initial rotation of the actuator.

Once the locking elements 221 are seated against the hinge plates 127 (as illustrated in FIG. 10), the hinge plates limit further movement of the locking system 221, 225 toward the locking position. Continued rotation of the actuator 115 causes the actuator body 201 and contact surface 251 to push the cross bar 233 away from the open end 121 of the housing 111. The force applied by the actuator 115 to the cross bar 233 is transferred through the travel bar to the locking elements 221 so the angled forward edges 273 thereof push against the tabs 281 to increase the force pivoting the hinge plates toward the closed position. Meanwhile, the closing arm 203 continues to push down on the hinge plates 127 so the closing arm and locking elements 221 collectively drive the pivoting movement of the hinge plates.

Once the hinge plates 127 pass through the co-planar position, the resulting toggling action reverse the direction of the housing spring force and the hinge plates continue pivoting movement toward the close position under the influence of the forces applied by housing spring force, actuator 115 and/or locking elements 221. The rotating actuator 115 pushes the locking system 221, 225 to the locking position after the hinge plates 127 have pivoted sufficiently toward the closed position to permit this movement. As the travel bar 225 is pushed to the locking position, the protrusion 245 slides across the detent 159 and the travel bar flexes away from the plateau 117 until the apex 247 of the protrusion is aligned with the detent. Initial interactions between the retaining formations 239, 241 produce forces tending to resist movement of the travel bar toward the locking position. Once the apex 247 of the protrusion 245 has slid past the detent 159, the direction of the forces produced by the retaining formations 239, 241 is reversed and a force F1 (FIG. 10) urges the travel bar 225 to continue moving toward the locked position. As the travel bar 225 approaches its locked position, the detent 159 is received in the recess 235*b*. When the detent 159 snaps into the second recess 235*b*, feedback (e.g., an audible sound, a tactile sensation) is be produced to provide confirmation to the user that the closing movement is complete and the rings 113 are locked. At this point, the retaining formations 239, 241 once again releasably hold the travel bar 225 and the locking elements thereon 221 in the locking position.

When introducing elements of the ring binder mechanisms herein, the articles "a", "an", "the" and "said" are intended to mean that there are one or more of the elements. The terms "comprising", "including" and "having" and variations thereof are intended to be inclusive and mean that there may be additional elements other than the listed elements. Moreover, the use of "forward" and "rearward" and variations of these terms, or the use of other directional and orientation terms, is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring binder mechanism for holding loose-leaf pages, the mechanism comprising:

an elongate housing;

rings for holding the loose-leaf pages, each ring including a first ring member and a second ring member, the first ring members being moveable relative to the housing and the second ring members between a closed position and an open position, in the closed position the first and second ring members forming a substantially continuous, closed loop for allowing loose-leaf pages retained by the rings to be moved along the rings from one ring member to the other, and in the open position the first and second ring members forming a discontinuous, open loop for adding or removing loose-leaf pages from the rings;

first and second hinge plates supported by the housing for pivoting motion relative to the housing, said first ring members being mounted on the first hinge plate and moveable with the pivoting motion of the first hinge plate between the closed and open positions;

an actuator moveable relative to the housing to cause the pivoting motion of the hinge plates, the actuator being moveable between a first position in which the ring members are in the closed position and a second position in which the ring members are in the open position; and a travel bar operatively connected to the actuator, the travel bar including a locking element, the travel bar being moveable between a locked position in which the locking element blocks pivoting movement of the hinge plates to move the rings from the closed position to the open position and an unlocked position in which the locking element permits pivoting movement of the hinge plates to open the rings, wherein the travel bar and housing each comprise a retaining formation, the retaining formation on the housing being adapted to contact the retaining formation on the travel bar to releasably hold the travel bar in the locked position when the rings are closed, and wherein the actuator comprises:

a body;

a closing arm extending from the body and positioned to pivot the hinge plates to move the rings to the closed position when the actuator moves from the second position to the first position; and an opening arm extending from the body and positioned to pivot the hinge plates and move the rings to the open position when the actuator moves from the first position to the second position.

2. A ring mechanism as set forth in claim 1 wherein the retaining formation on the travel bar includes a pair of recesses comprising a first recess and a second recess, the second recess being positioned closer to the actuator than the first recess, and wherein the retaining formation on the housing comprises a detent.

3. A ring mechanism as set forth in claim 2, wherein the detent is positioned to be received in the second recess when the travel bar is in the locked position.

4. A ring mechanism as set forth in claim 3, wherein the detent is positioned to be received in the first recess when the travel bar is in the unlocked position.

5. A ring mechanism as set forth in claim 4 wherein the retaining formations are configured to interact with one another to produce a force resisting movement of the travel bar away from the locked position when the rings are closed and to produce a force resisting movement of the travel bar away from the unlocked position when the travel bar is in the unlocked position.

6. A ring mechanism as set forth in claim 5 wherein the retaining formations are adapted so the direction of a force applied to the travel bar as a result of interaction of the retaining formations is reversed as the travel bar moves between the locked and unlocked positions.

7. A ring mechanism as set forth in claim 4, wherein the detent snaps into the second recess upon movement of the travel bar from the unlocked position to the locked position.

8. A ring mechanism as set forth in claim 1 wherein the retaining formations on the travel bar and housing are first retaining formations, respectively, the travel bar and housing each further comprising a second retaining formation, the second retaining formations being spaced from the actuator and spaced from the first retaining formations, wherein the first and second retaining formations on the housing are adapted to contact the respective retaining formations on the travel bar and collectively releasably hold the travel bar in the locked position when the rings are closed.

9. A ring mechanism as set forth in claim 8 wherein the each of the first and second retaining formations on the travel bar comprise a pair of recessed and each of the retaining formations on the housing comprises a detent positioned to be received in a first of the pair of recesses when the travel bar is in the locked position and a second of the pair of recesses when the travel bar is in the unlocked position.

10. A ring mechanism as set forth in claim 8 wherein the retaining formations on the travel bar and housing are positioned so there is at least one ring positioned longitudinally on the ring mechanism between the actuator and each of the retaining formations and so there is at least one ring positioned between the first and second retaining formations.

11. A ring mechanism as set forth in claim 1, wherein the retaining formations on the travel bar and housing are positioned so there is at least one ring positioned longitudinally on the ring mechanism between the retaining formations and the actuator.

12. A ring mechanism as set forth in claim 1, wherein said locking element is a first locking element and the travel bar includes a plurality of locking elements spaced along a length of the travel bar, said first locking element being one of said plurality of locking elements.

13. A ring mechanism as set forth in claim 12, wherein the retaining formation on the travel bar is spaced along the travel bar from the locking element.

14. A ring mechanism as set forth in claim 1, wherein the travel bar is adapted to flex away from the housing at the location of the retaining formation thereon to permit movement of the travel bar between the locked position and the unlocked position.

15. A ring mechanism as set forth in claim 1, wherein the retaining formation on the housing extends down from a top portion of the housing.

16. A ring mechanism as set forth in claim 1, wherein the actuator includes a slot positioned between the closing arm and the body, the slot receiving a connector connecting the travel bar to the actuator.

17. A ring mechanism as set forth in claim 16, wherein the travel bar has arms extending longitudinally of the housing and a cross bar at the end extending between the arms, the cross bar being said connector.

18. A ring mechanism as set forth in claim 1, wherein the retaining formation on the housing comprises a detent and the retaining formation on the travel bar comprises a protrusion, wherein the protrusion and the detent have inclined surfaces adapted to interact with one another to produce a force that tends to resist movement of the travel bar away from the locked position.

19. A ring mechanism as set forth in claim 1, wherein the retaining formations are spaced from the actuator.

20. A ring mechanism as set forth in claim 1 in combination with a notebook cover, the ring mechanism being secured to the notebook cover.

21. A ring binder mechanism for holding loose-leaf pages, the mechanism comprising:

an elongate housing;

rings for holding the loose-leaf pages, each ring including a first ring member and a second ring member, the first ring members being moveable relative to the housing and the second ring members between a closed position and an open position, in the closed position the first and second ring members forming a substantially continuous, closed loop for allowing loose-leaf pages retained by the rings to be moved along the rings from one ring member to the other, and in the open position the first and second ring members forming a discontinuous, open loop for adding or removing loose-leaf pages from the rings;

first and second hinge plates supported by the housing for pivoting motion relative to the housing, said first ring members being mounted on the first hinge plate and moveable with the pivoting motion of the first hinge plate between the closed and open positions;

an actuator moveable relative to the housing to cause the pivoting motion of the hinge plates, the actuator being moveable between a first position in which the ring members are in the closed position and a second position in which the ring members are in the open position; and a travel bar operatively connected to the actuator, the travel bar including a locking element, the travel bar being moveable between a locked position in which the locking element blocks pivoting movement of the hinge plates to move the rings from the closed position to the open position and an unlocked position in which the locking element permits pivoting movement of the hinge plates to open the rings, wherein the travel bar and housing each comprise a retaining formation, the retaining formation on the housing being adapted to contact the retaining formation on the travel bar to releasably hold the travel bar in the locked position when the rings are closed, and wherein the retaining formation on the travel bar includes a pair of recesses comprising a first recess and a second recess, the second recess being positioned closer to the actuator than the first recess, and wherein the retaining formation on the housing comprises a detent.

22. A ring binder mechanism for holding loose-leaf pages, the mechanism comprising:

an elongate housing;

rings for holding the loose-leaf pages, each ring including a first ring member and a second ring member, the first ring members being moveable relative to the housing and the second ring members between a closed position and an open position, in the closed position the first and second ring members forming a substantially continuous, closed loop for allowing loose-leaf pages retained by the rings to be moved along the rings from one ring member to the other, and in the open position the first and second ring members forming a discontinuous, open loop for adding or removing loose-leaf pages from the rings;

first and second hinge plates supported by the housing for pivoting motion relative to the housing, said first ring members being mounted on the first hinge plate and moveable with the pivoting motion of the first hinge plate between the closed and open positions;

an actuator moveable relative to the housing to cause the pivoting motion of the hinge plates, the actuator being moveable between a first position in which the ring members are in the closed position and a second position in which the ring members are in the open position; and a travel bar operatively connected to the actuator, the travel bar including a locking element, the travel bar being moveable between a locked position in which the locking element blocks pivoting movement of the hinge plates to move the rings from the closed position to the open position and an unlocked position in which the locking element permits pivoting movement of the hinge plates to open the rings, wherein the travel bar and housing each comprise a retaining formation, the retaining formation on the housing being adapted to contact the retaining formation on the travel bar to releasably hold the travel bar in the locked position when the rings are closed, and wherein the retaining formations on the travel bar and housing are first retaining formations, respectively, the travel bar and housing each further comprising a second retaining formation, the second retaining formations being spaced from the actuator and spaced from the first retaining formations, wherein the first and second retaining formations on the housing are adapted to contact the respective retaining formations on the travel bar and collectively releasably hold the travel bar in the locked position when the rings are closed.

23. A ring binder mechanism for holding loose-leaf pages, the mechanism comprising:

an elongate housing;

rings for holding the loose-leaf pages, each ring including a first ring member and a second ring member, the first ring members being moveable relative to the housing and the second ring members between a closed position and an open position, in the closed position the first and second ring members forming a substantially continuous, closed loop for allowing loose-leaf pages retained by the rings to be moved along the rings from one ring member to the other, and in the open position the first and second ring members forming a discontinuous, open loop for adding or removing loose-leaf pages from the rings;

first and second hinge plates supported by the housing for pivoting motion relative to the housing, said first ring members being mounted on the first hinge plate and moveable with the pivoting motion of the first hinge plate between the closed and open positions;

an actuator moveable relative to the housing to cause the pivoting motion of the hinge plates, the actuator being moveable between a first position in which the ring members are in the closed position and a second position in which the ring members are in the open position; and a travel bar operatively connected to the actuator, the travel bar including a locking element, the travel bar being moveable between a locked position in which the locking element blocks pivoting movement of the hinge plates to move the rings from the closed position to the open position and an unlocked position in which the locking element permits pivoting movement of the hinge plates to open the rings, wherein the travel bar and housing each comprise a retaining formation, the retaining formation on the housing being adapted to contact the retaining formation on the travel bar to releasably hold the travel bar in the locked position when the rings are closed, and wherein the retaining formations on the travel bar and housing are positioned so there is at least one ring positioned longitudinally on the ring mechanism between the retaining formations and the actuator.

* * * * *